United States Patent [19]

Freeman et al.

[11] 4,171,562

[45] Oct. 23, 1979

[54] METHOD FOR IMPROVING FATIGUE PROPERTIES IN CASTINGS

[75] Inventors: William R. Freeman, N. Muskegon; Louis E. Dardi, Norton Shores, both of Mich.

[73] Assignee: Howmet Turbine Components Corporation, Muskegon, Mich.

[21] Appl. No.: 840,134

[22] Filed: Oct. 7, 1977

[51] Int. Cl.[2] ..... B22D 11/126

[52] U.S. Cl. ..... 29/530; 164/113; 29/526.2; 29/527.1

[58] Field of Search ..... 29/527.2, 420.5, 527.1, 29/530, 527.3, 526.4, 526.2; 164/113

[56] References Cited

U.S. PATENT DOCUMENTS

| | | | |
|---|---|---|---|
| 3,758,347 | 9/1973 | Stalker | 148/4 |
| 4,021,910 | 5/1977 | Freeman, Jr. et al. | 29/526.2 |

*Primary Examiner*—Francis S. Husar

*Assistant Examiner*—V. K. Rising

*Attorney, Agent, or Firm*—McDougall, Hersh & Scott

[57] ABSTRACT

A method for producing cast, superalloy, ferrous and titanium articles comprising the formation of a material void in the cast article, for example by utilizing a core during the casting operation or by machining a void after casting. The void is sealed relative to the surrounding atmosphere and the article is then subjected to an elevated temperature and pressure treatment in a gaseous atmosphere whereby the metal in the area of the void will yield so that the void is partially or totally eliminated. The pressure application is carried out at a temperature such that local deformation of the cast structure occurs in the region previously occupied by, and adjacent to, the void whereby a fine-grained recrystallized structure is developed in this section. Grain refined cast articles are characterized by superior low-cycle fatigue and tensile properties.

9 Claims, 6 Drawing Figures

METHOD FOR IMPROVING FATIGUE PROPERTIES IN CASTINGS

BACKGROUND OF THE INVENTION

This invention generally relates to the production of high performance castings. In particular, the invention is directed to techniques for producing turbine components and other superalloy, ferrous, or titanium articles which are subjected to similar operating conditions.

Turbine components, for example turbine wheels, are subjected to operating conditions which place great demand upon the components. Thus, it is well known that the temperature and atmospheric conditions to which turbine components are subjected require properties in the components which will insure suitably consistent performance for a reasonably long period of time.

Turbine wheels lead to particular production problems since the blade sections of such wheels are subjected to stresses and other operating conditions which are distinct from the conditions to which the disc section of the wheels are exposed. Cast turbine wheels have been produced in an integral fashion; however, such wheels cannot be produced consistently with desired properties. In particular, the disc sections of the integral castings do not achieve desired low-cycle fatigue behavior even though the cast blade sections might be suitable.

Composite turbine wheels are produced involving the separate formation of blades through the use of precision casting operations. The disc sections of the wheels are separately formed, forging operations being utilized for this purpose. The blades are then connected to the disc section, usually by mechanical means, and the composite structure provides a suitable combination. Thus, the cast structure of the blades is suitable for the conditions to which the blades are exposed while the forged structure of the discs provides suitable properties in this area.

The production of composite turbine components leads to other problems, however, for example the additional steps involved and the necessity for insuring that precision machining operations and the like are properly conducted. Composite structures thus lead to additional expense when compared with structures which can be produced integrally. Also, many designs are limited by the rim space available for blade attachment precluding the use of composite turbine components.

Hot isostatic pressing has also been proposed as a means for improving the properties of superalloy turbine components, for example as described in Freeman, et. al. U.S. Pat. No. 4,021,910 issued on May 10, 1977. The refinement of grain size for improving fatigue capability has also been proposed including the use of nucleants in the facecoat of ceramic molds for producing fine grained castings. However, this process is not capable of refining grains to the extent exhibited by forgings and achieving significant refinement in heavy sections is particularly difficult.

SUMMARY OF THE INVENTION

This invention involves still further techniques for the production of integral superalloy, ferrous and titanium cast articles. The invention is particularly concerned with the production of turbine components including turbine wheels whereby such components can be obtained as integral articles but with properties suitable for varying conditions to which different sections of the articles are exposed.

The method of this invention particularly involves the casting of superalloy articles and the deliberate formation of material voids in sections of the articles. Such material voids can be formed by employing cores during casting so that the voids are in the articles in the as-cast condition. It is also contemplated that the voids can be machined in the desired sections of the articles after completion of the casting operation.

The voids of the articles are capped, usually after evacuation of the voids. Thereafter, the articles are subjected to elevated temperature and high pressure treatment for purposes of closing the voids and achieving controlled deformation in regions in, and adjacent to, areas defining the void. Thus, the temperatures and pressures are selected so that the metal will yield during this operation.

It has been found that the formation of the voids and the subsequent heating under high pressure for closing of the voids results in the deformation and associated recrystallization of the metal in each section of an article previously occupied by a void. The area of recrystallization will extend substantially beyond the original void dimensions. Moreover, the recrystallization which occurs in accordance with this invention is such that a fine-grained microstructure develops. Conditions may be selected such that deformation takes place without, or with partial, recrystallization. In this instance, recrystallization would be completed in subsequent heat treatment, usually at a higher processing temperature.

As a result of the procedures of this invention, the properties of sections of an integral casting can be controlled to distinguish from the properties in a separate section of the casting. Moreover, the fine-grained structure which is produced in accordance with this invention is characteristic of the structure achieved from a forging operation. It is, therefore, possible to achieve a cast structure in sections of a casting, such as the blades of a turbine wheel, whereby the advantageous properties of the cast structure are obtained. At the same time, it is possible to achieve a forged structure in distinct sections of a casting, for example, in the hub of a turbine wheel, whereby the advantages of that microstructure can be realized. By appropriate control of the original void configuration and processing conditions, a gradual transition between the cast and recrystallized structure can be obtained if desired.

DESCRIPTION OF THE DRAWINGS

FIG. 1 is a cross-sectional view of a turbine blade and disc structure illustrating a version of the invention;

DESCRIPTION OF THE PREFERRED EMBODIMENTS

Castings are considered to have generally less suitable microstructures when considering fatigue strength.

achieved. The following comprise typical compositions of cast materials contemplated for the application of this invention:

| Alloy Designation | COMPOSITION, W/O | | | | | | | | | | | | | | | |
|---|---|---|---|---|---|---|---|---|---|---|---|---|---|---|---|---|
| | Cr | Mo | Ta | W | Cb | Co | Ti | Al | Hf | C | B | Zr | Cu | Ni | Fe | V |
| IN792 | 12.5 | 2 | 4 | 4 | — | 9 | 4 | 3.5 | — | 0.09 | 0.015 | 0.04 | — | Bal. | — | — |
| IN718 | 19 | 3 | — | — | 5 | — | 1 | 0.5 | — | 0.05 | — | — | — | Bal. | — | — |
| IN713C | 13 | 4 | — | — | 2 | — | 0.5 | 5.5 | — | 0.1 | 0.015 | 0.10 | — | Bal. | — | — |
| Custom 450 | 15 | 0.75 | — | — | 8×C | — | — | — | — | 0.04 | — | — | 1.5 | 6.0 | Bal. | — |
| 17-4PH | 16.5 | — | — | — | 0.25 | — | — | — | — | 0.03 | — | — | 3.6 | 4.25 | Bal. | — |
| Ti-6A1-4V | — | — | — | — | — | — | Bal. | 6 | — | — | — | — | — | — | — | — |

Cylinders prepared from cast nickel base superalloys of the type referred to were provided with bores from 0.40 to 1.0 inches in diameter. The cylinders were located in a vacuum chamber, and while maintained in a vacuum, end caps were applied to provide a pressure-tight enclosure. Vacuum brazing was employed as a means for securing the caps; however, electron beam welding, fusion welding and inertia welding are contemplated as suitable procedures.

The evacuated and sealed articles were then located in an autoclave, and the temperature and pressures were increased to 2200° F. and 15,000 psi, respectively. The articles were maintained under these conditions for four hours.

Figure 6:
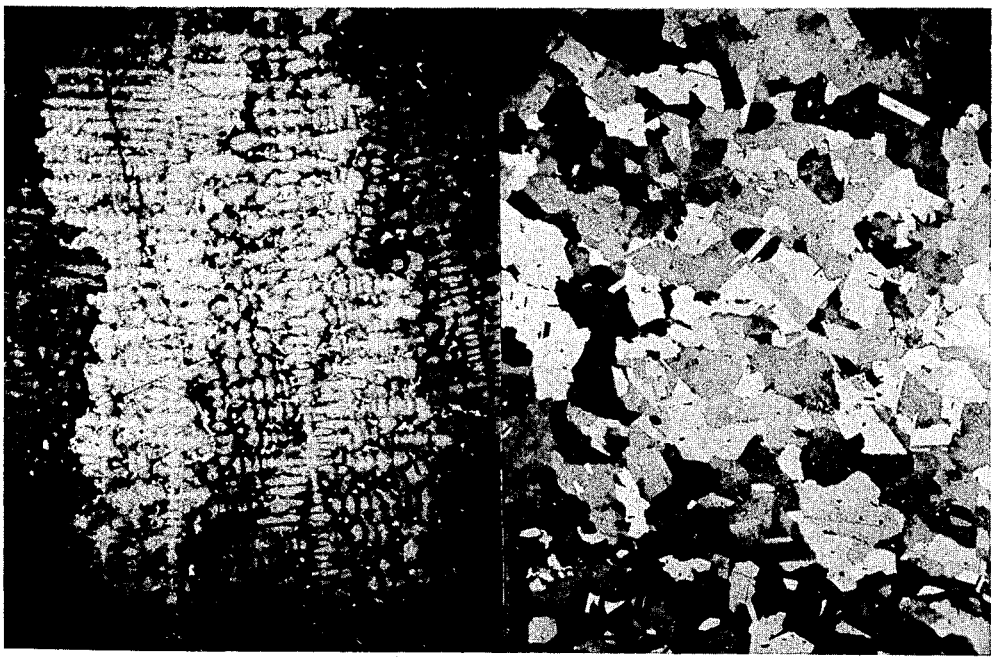
FIG. 6 represents microstructures of typical castings and the effect of subject grain refinement process.
Figure 2:
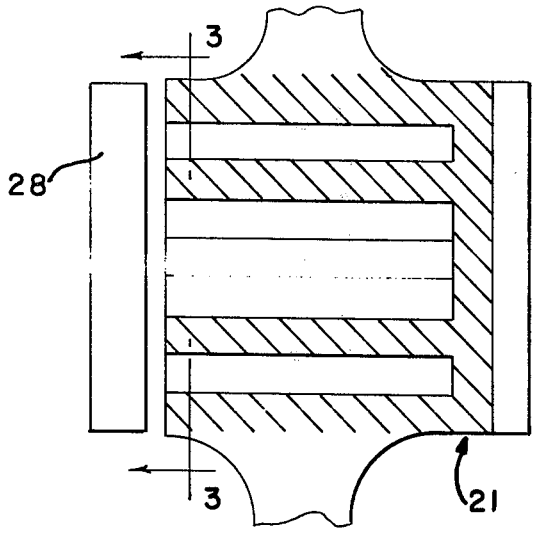
FIG. 2 is a vertical cross-sectional view of an article having voids formed therein in accordance with this invention.
Figure 3:
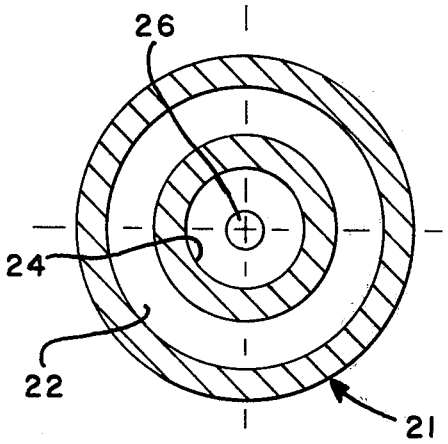
FIG. 3 is a horizontal cross-sectional view taken about the line 3—3 of FIG. 2.
Figure 4:
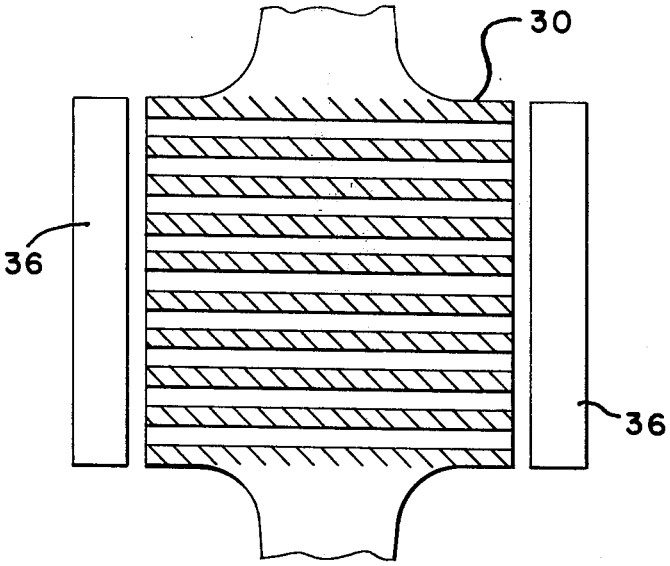
FIG. 4 is a vertical, cross-sectional view illustrating a different pattern of voids in a cast article.
Figure 5:
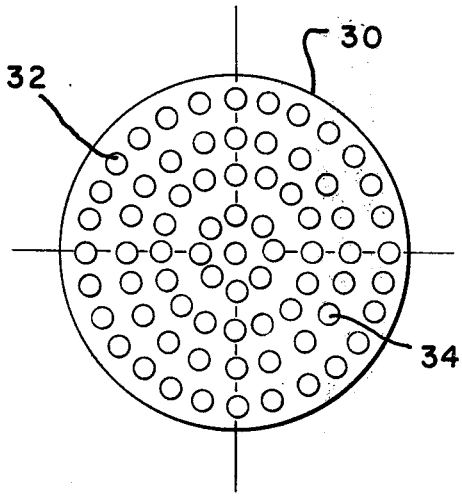
FIG. 5 is an end view of the article of FIG. 4.

Microexamination of the cross sections of the articles revealed complete closing of the bores. Furthermore, the metal in the area surrounding the bores was completely recrystallized, and a fine-grained microstructure was developed per FIG. 6.

This figure specifically shows a typical cast microstructure magnified 25 times, that is, a microstructure of the type schematically shown in FIG. 1. The adjacent illustration of a fine-grained microstructure, also magnified 25 times, is typical of the results obtained by the practice of this invention.

Tensile strengths generally were increased and ductility maintained or increased in accordance with the following:

| Alloy | Process | Properties | | | |
|---|---|---|---|---|---|
| | | UTS (Ksi) | 0.2% YS (Ksi) | Elong. (%) | R. of A. (%) |
| IN792 | Cast | 148 | 130 | 3.5 | 5.5 |
| | Cast + Recrystallized | 191 | — | 7.3 | 8.3 |
| | Cast + HIP | 148 | 136 | 16 | 32 |
| IN718 Heat Treat A | Cast + Recrystallized | 168 | 147 | 20 | 31 |
| | Cast + HIP | 129 | 107 | 25 | 33 |
| IN718 Heat Treat B | Cast + Recrystallized | 151 | 120 | 20 | 21 |

The concurrent improvement in these tensile properties translates to increased low cycle fatigue strength. The significant increase in ultimate strength implies also an improvement in high cycle fatigue properties. Similar tests conducted in the range 2125°–2225° F./15 ksi/4 and 2100°–2225° F./30 ksi/4 produced similar results.

The utilization of a plug within the castings provides a means for facilitating the provision of a bore whereby the article produced can accommodate a through shaft or the like. The plug serves as a means for controlling the deformation of the casting during the hot isostatic pressing. Thus, the plug provides a means for limiting inward deformation so that irregularities in localized areas of a casting are not likely to develop.

It will be appreciated that the above described invention is applicable to superalloy articles other than turbine components. Any structure which will be benefitted particularly in the area of low-cycle fatigue properties can be produced in accordance with this invention to achieve a desired microstructure particularly of the type characteristic of forged articles.

It will be understood that various changes and modifications may be made in the above described procedure which provide the characteristics of this invention without departing from the spirit thereof particularly as defined in the following claims.

That which is claimed is:

1. In a method for producing a cast superalloy, ferrous or titanium article comprising the steps of forming at least one material void in the cast article by removing material from the article after casting, the amount of material removed being at least sufficient to result in at least a 10 percent size reduction of the article when the void is closed upon compression of the article, the compression of the article comprising the steps of capping the void to thereby seal the void relative to surrounding atmosphere, heating the article to a temperature sufficient to achieve metal movement while exposing the article to a pressure of at least about 5,000 psi by means of a surrounding gaseous atmosphere, said temperature and pressure application being maintained for a time sufficient to close the void and for the development of a fine-grained structure in, and adjacent to, the section of the article previously defining the void.

2. A method in accordance with claim 1 including the step of evacuating said void prior to capping of the void.

3. A method in accordance with claim 1 including the step of evacuating said remaining void prior to capping of the remaining void.

4. A method in accordance with claim 1 including the step of inserting a mandrel in the hole formed by said void to thereby reduce the size of the void, said mandrel being smaller than the void, the remaining void comprising the space defined between the opposed surfaces of the mandrel and hole, and including the step of removing said mandrel after closing of said remaining void to thereby provide an opening in said article.

5. A method for producing a cast superalloy, ferrous or titanium article comprising the steps of forming at least one material void in the cast article by machining a hole in said article, capping the void to thereby seal the void relative to surrounding atmosphere, heating the article to a temperature sufficient to achieve metal movement while exposing the article to a pressure of at least about 5,000 psi by means of a surrounding gaseous atmosphere, said temperature and pressure application being maintained for a time sufficient to close the void and for the development of a fine-grained structure in, and adjacent to, the section of the article previously defining the void.

6. A method in accordance with claim 1 including the step of inserting a mandrel in said hole, said mandrel being of smaller dimensions than the hole whereby said void comprises the space defined between the opposed surfaces of the mandrel and hole, and including the step of removing said mandrel after closing of said void to thereby provide an opening in said article.

7. A method in accordance with claim 5 including the step of evacuating said void prior to capping of the void.

8. A method for producing a cast superalloy, ferrous or titanium article comprising the steps of forming at least one material void in the cast article, said void being formed by locating at least one core in a mold and casting the article in said mold whereby solidification around the core takes place, and thereafter removing the core so that the void is present in the article in the as-cast condition, capping the void to thereby seal the void relative to surrounding atmosphere, heating the article to a temperature sufficient to achieve metal movement while exposing the article to a pressure of at least about 5,000 psi by means of a surrounding gaseous atmosphere, said temperature and pressure application being maintained for a time sufficient to close the void and for the development of a fine-grained structure in, and adjacent to, the section of the article previously defining the void.

9. A method in accordance with claim 8 including the step of inserting a mandrel in the hole formed by said void to thereby reduce the size of the void, said mandrel being smaller than the void, the remaining void comprising the space defined between the opposed surfaces of the mandrel and hole, and including the step of removing said mandrel after closing of said remaining void to thereby provide an opening in said article.

* * * * *

United States Patent [19]

Withoos

[11] 4,171,563

[45] Oct. 23, 1979

[54] METHOD OF MANUFACTURING AN ANTENNA REFLECTOR

[75] Inventor: Wilhelmus H. C. Withoos, Eindhoven, Netherlands

[73] Assignee: U.S. Philips Corporation, New York, N.Y.

[21] Appl. No.: 854,781

[22] Filed: Nov. 25, 1977

[30] Foreign Application Priority Data

May 20, 1977 [NL] Netherlands ..... 7705557

[51] Int. Cl.[2] ..... H01P 11/00

[52] U.S. Cl. ..... 29/600; 29/527.4; 156/245; 264/299

[58] Field of Search ..... 29/600, 601, 527.4; 156/245; 425/129; 264/267, 268, 269, 299

[56] References Cited

U.S. PATENT DOCUMENTS

| | | | |
|---|---|---|---|
| 2,805,974 | 9/1957 | Brucker | 29/600 |
| 2,858,603 | 11/1958 | Herrmann | 72/46 |
| 3,125,801 | 3/1964 | Fields | 425/129 |
| 3,296,685 | 1/1967 | Suliteanu | 29/600 |
| 3,897,294 | 7/1975 | MacTurk | 156/245 |

FOREIGN PATENT DOCUMENTS

| | | | |
|---|---|---|---|
| 538632 | 1/1956 | Italy | 72/350 |
| 1371102 | 10/1974 | United Kingdom | 425/129 |

*Primary Examiner*—Lowell A. Larson
*Attorney, Agent, or Firm*—Algy Tamoshunas

[57] ABSTRACT

The invention relates to the maufacture of reflectors of electromagnetic radiation, in which a flat and thin metal foil, for example an annealed copper foil which is clamped along its circumference is deformed plastically by means of a mould which has a convex surface. In the final position the mould with the deformed foil is at some distance from the surface of the matrix. The space between deformed foil and matrix is filled with a liquid synthetic resin, for example a foam-forming polyurethane resin. After complete or partial curing of the synthetic resin the mould is removed and the resulting assembly of deformed foil and synthetic resin layer connected thereto is removed from the matrix. In an interesting embodiment a matrix is used the concave surface of which has recesses so that in the finished reflector the supporting layer is provided with corresponding bosses, such as reinforcement ribs. In a further interesting embodiment a mould is used which has a central annular recess so that in the finished reflector in the optical center thereof a perforated hub is obtained which is of importance for aligning the reflector.

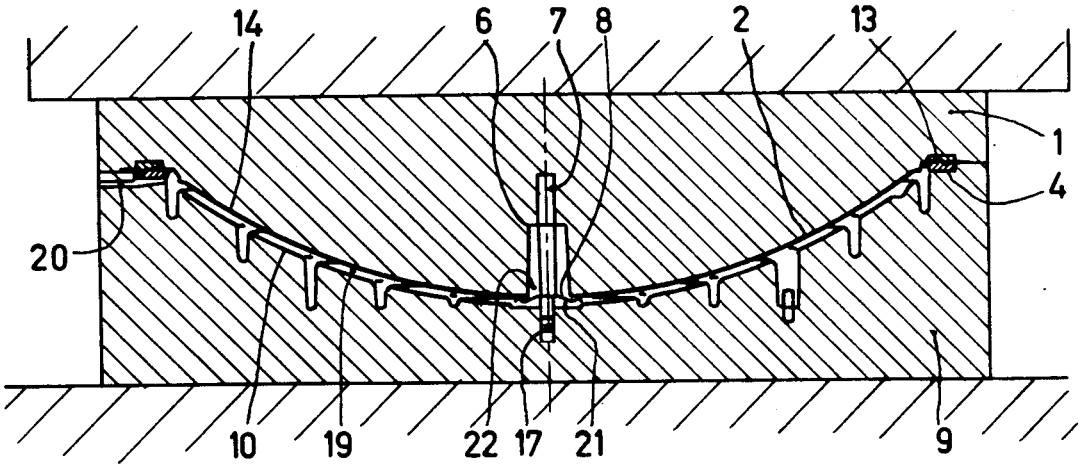

16 Claims, 5 Drawing Figures